US009469506B2

(12) United States Patent
Scomparin

(10) Patent No.: US 9,469,506 B2
(45) Date of Patent: Oct. 18, 2016

(54) SYSTEM OF VERTICAL AND HORIZONTAL MOVEMENT OF THE TRANSPORT CABIN IN A ELEVATOR TRANSLATOR PLANT FOR THE OVERCOMING OF OBSTACLES

(71) Applicant: Pedarco International Limited, Central (HK)

(72) Inventor: Tarcisio Scomparin, Spresiano (IT)

(73) Assignee: Pedarco International Limited, Central (HK)

( * ) Notice: Subject to any disclaimer, the term of this patent is extended or adjusted under 35 U.S.C. 154(b) by 269 days.

(21) Appl. No.: 14/346,694

(22) PCT Filed: Sep. 19, 2012

(86) PCT No.: PCT/IB2012/001824
§ 371 (c)(1),
(2) Date: Mar. 21, 2014

(87) PCT Pub. No.: WO2013/041941
PCT Pub. Date: Mar. 28, 2013

(65) Prior Publication Data

US 2014/0224147 A1 Aug. 14, 2014

(30) Foreign Application Priority Data

Sep. 22, 2011 (IT) ..... TV2011A0126

(51) Int. Cl.
*B66B 9/00* (2006.01)
*B66B 9/16* (2006.01)
*B66B 9/04* (2006.01)

(52) U.S. Cl.
CPC ..... *B66B 9/003* (2013.01); *B66B 9/04* (2013.01); *B66B 9/16* (2013.01)

(58) Field of Classification Search
CPC ..... B66B 9/16; B66B 9/187; B66B 9/00; B66B 9/003; B66B 9/04; B66B 2009/006
USPC ..... 104/107
See application file for complete search history.

(56) References Cited

U.S. PATENT DOCUMENTS 3,698,326 A 10/1972 Schurch et al.
3,918,367 A * 11/1975 Alimanestianu ..... B61B 1/02 104/127

(Continued)

FOREIGN PATENT DOCUMENTS

CN 101314449 12/2008
CN 101391720 3/2009

(Continued)

OTHER PUBLICATIONS

International Search Report, mailing date Jun. 12, 2012 for corresponding International Application No. PCT/IB2012/001824.

*Primary Examiner* — Mark Le
(74) *Attorney, Agent, or Firm* — Intellectual Property Law Group LLP

(57) ABSTRACT

Handling system of a cabin of transportation (20) moveable along an overhead type "U" portal (10), that connects two stations of departure (A) and arrival (B), the system includes columns (11, 12, 13, 14) and guide beams (15, 16) to which the cabin (2) is bound by a slide (200) apt to make the horizontal movement with respect to the guide beams (15, 16), with a carriage (300) apt to perform the vertical movement with respect to the guide columns (11, 12, 13, 14). The carriage (300) being engageable with the slide (200) to accomplish the vertical movement with respect to the guide columns (11, 12, 13, 14). The cabin (20) is moved in the vertical and horizontal direction by a closed ring chain (100) to which is bound the slide (200), and the chain (1100) is driven by a motor (110).

6 Claims, 7 Drawing Sheets

(56) References Cited

U.S. PATENT DOCUMENTS 4,856,956 A * 8/1989 Zur ..... B65G 1/0435 198/626.5
6,240,851 B1 * 6/2001 Oudakker ..... B61B 13/00 104/127
6,923,612 B2 * 8/2005 Hansl ..... B66F 9/07 414/277
8,721,250 B2 * 5/2014 Razumov ..... B65G 1/0492 108/144.11
8,751,035 B2 * 6/2014 Janet ..... B65G 49/00 700/213
9,010,251 B2 * 4/2015 Creissels ..... B61B 1/02 104/30
2007/0107620 A1 * 5/2007 Wagner ..... A63H 19/30 104/53
2010/0319565 A1 * 12/2010 Mobasher ..... B61B 1/02 104/89
2013/0180425 A1 * 7/2013 Creissels ..... B61B 1/02 104/28

FOREIGN PATENT DOCUMENTS

CN 201296896 Y 8/2009
EP 1574467 A1 9/2005
FR 2638439 A1 5/1990
JP 2002370881 A 12/2002

* cited by examiner

SYSTEM OF VERTICAL AND HORIZONTAL MOVEMENT OF THE TRANSPORT CABIN IN A ELEVATOR TRANSLATOR PLANT FOR THE OVERCOMING OF OBSTACLES

CROSS-REFERENCE TO RELATED APPLICATIONS

This application is a U.S. National Phase application, under 35 U.S.C. §371, of International Application no. PCT/IB2012/001824 with an international filing date of Sep. 19, 2012, and claims benefit of Italian Application no. TV2011A000126 filed on Sep. 22, 2011, which are hereby incorporation by reference for all purposes.

BACKGROUND OF THE INVENTION

1. Field of Invention

The present invention relates to a system of vertical and horizontal movement of the transport cabin of persons and things in a plant elevator translator for the overhead overcoming to and from also automatic of obstacles such as, for example, roads, motorways, crossings and any other obstacle affected by driveways, particularly for pedestrians.

2. Background

The crossing of obstacles, such as for example roads intended for circulation of vehicles on wheels but also on rails, by pedestrians, merchandise or cycles such as bicycles, typically occurs through level passages, bridges or subways. Assuming level crossing, which constitute by far the majority of cases, even when they are assisted by traffic lights, it is observed that are somewhat dangerous, especially for pedestrians and cycles, as it is used substantially the same physical space, giving rise to collisions and accidents. The traffic light installations, while adjusting the alternation of the passage of pedestrians and vehicles, requires the arrest of the latter with inevitable waste of energy, the emission of polluting fumes and the formation of queues. Pedestrians and environment are so subject to greater contamination. The elevated bridges and subways instead get the physical separation of the flows. They have however the drawback of being expensive and occupy a lot of space. In addition to the scales, they require the addition of elevators specially dedicated to people with mobility difficulties. The underground passages, result the most expensive both for their construction that for their maintenance. In some cases, they result totally impractical for the presence of obstacles such as water or gas pipes, conduits, subways, tunnels, archaeological or geological or adverse geostationary conditions. Finally, subways, being uncomfortable and hidden places, are often the scenes of crimes and are often avoided by many people. Even the overcoming of obstacles of different nature, such as waterways, occurs with bridges and underpasses.

STATE OF THE ART

A quick search in the context of patent applications and granted patents, while not exhaustive, allowed to identify the following prior art documents:

D1 JP2002370881A (Yazawa)
D2 CN201296896Y
D3 CN101314449 (Xin)
D4 CN101391720 (Xinqi)

D1 Proposes a device consisting of two elevators arranged at the end of an interconnection bridge, connected to each other by means of the carrying ropes so that the cabin of one constitutes the counterweight of the cabin of the other and vice-versa so that while the cabin of one raises, the cabin of the other drops. It's beautiful in appearance, produces a saving of space, can be installed on existing bridges. CONSTRUCTION: This elevator device for an air bridge of interconnection includes a first elevator located to an extreme point of the air bridge of interconnection that reciprocally separates two points and a second elevator disposed on the opposite side. First and second elevator are mutually connected by a main rope with a lift and connection function, that passing laterally, under or over the of the same interconnection bridge inside of a designed passageway, transfers the supporting action of the cabin of the first elevator to the cabin of the second elevator.

D2 Describes a pedestrian bridge with a vertical elevator with a glass wall, which has a main deck and pedestrian stairs arranged at both ends of the bridge. The bridge is supported by pylons arranged between the lower surface of the bridge and the ground. The vertical elevator at one or both ends has an input/output facing the walkway of the bridge. CONSTRUCTION: The utility model combines a pedestrian bridge to a vertical elevator with curtain or glass walls and is made with known materials and technologies, fulfills the functions for which it is intended, has a good resistance to vibration and ultimately allows you to enjoy the urban landscape.

D3 proposes an automatic elevator for overpass, which adopts some "H" shaped slide guides to enable a platform to the ascent and to the descent. Said H guides are formed of steel and are combined in parallel, and a traction machine is positioned in the upper part of said guides. A platform for elevation is with one end apt to support the passengers, the other end being engaged by sliding means to said H slide guide. The traction device is composed of cables and counterweights so as to port lift the said platform.

D4 suggests a device for the easy passage of intersections capable of replacing a semaphore. It is in particular a curved guide rail with a hanging cabin which moves in and from along said guide rail connecting two elevated platforms served by stairs, where said elevator cabin is moved by a traction device that is coupled to said cabin.

Ultimately, it is therefore reasonable to assume known:

- A raised passage for the pedestrian, positioned substantially transversely with respect to the obstacle, such as for example the passage of a road, where the said passage comprises at least two opposite flights of stairs and a connecting or overpassing bridge, said ramps of stairs being each positioned at one end of said bridge and insistent on the ground from the side of relevance;
- Two elevators, (see D1) positioned behind the stairs, which allow the lifting of the pedestrian from the ground up to the height of the pedestrian bridge that crosses the said road, and vice-versa;
- The use of a balancing system for the cabins of two elevators placed at the ends of a pedestrian bridge whose lifting rope is mutually connected so that the ascent of one corresponds the descent of the other (see D1);
- The use of glass, for the elevators in order to make the structure less impacting from the point of view of the environment and at the same time pleasant for the user;

The use of a transmission system for the elevation of the cabin, by rope and counterweights, with a traction device positioned at the upper end of the vertical guides/rails;

The use of a translation system of a suspended cabin from a first to a second end of a pedestrian crossing, which cabin uses a movement system that provides rotary mechanical means on the upper part of the same which engage the rack guide that is positioned transversely arched with respect to the obstacle to overcome.

Drawbacks

As a line of principle, one can identify some common drawbacks related to the known solutions that in the realization of an efficient system, apt to the combined movements of at least one cabin in both the vertical and horizontal directions, hampers the use of easy, flexible and particularly efficient solutions. In this case some factors that contribute to these important limitations and difficulties, can be summarized as follows:

The need to use several motors, which act in general, on likewise independent linear movements. Such motors, suitably driven, for example by electrical/electronic systems, impose to the load trajectories on more dimensions;

The considerable encumbrance that would characterize this type of machines. This is substantially due because of their complexity and more still dictated by the superposition of the individual dimensions of the systems of guides for supporting the load, or that support systems of guides, which in turn support the load or other systems of guides.

The considerable energy consumption of these devices when normally and in the best of the solutions, is applied a balancing system capable to reduce to half the maximum allowable load when this is transported.

Considered also these aspects, it is quite evident the need for the sector to identify some solutions more efficient and convenient by the economic profile.

SUMMARY OF THE INVENTION

A handling system of a movable transportation cabin (20) for the transport of persons and things along an overpass constituted of a "U" portal (10), in a urban elevator translator plant, of the overhead type raised across the obstacle and that connects two stations of departure (A) and arrival (B) opposed to each other, said overpass that includes columns (11, 12, 13, 14) and guide beams (15, 16) to which the said cabin (20) is bound by means of slide means (200) apt to make the horizontal movement with respect to the guide beams (15, 16), with carriage means (300) apt to perform the vertical movement with respect to the guide columns (11, 12, 13, 14) said carriage means (300) being of the type engageable with said slide means (200) to perform the said vertical movement with respect to the guide columns (11, 12, 13, 14), and wherein the said cabin (20) is moved vertically and horizontally by means of a closed ring chain (100) to which is bound the slide (200), said chain (100) of the type driven by a motor (110).

Purposes and Advantages

The solution just exposed, offers countless purposes and advantages, which are not to be considered limitative, in being able to identify some further hereinafter, which even if not mentioned, must be however included.

A first advantage and purpose consists in the reduction of the number of engines with the consequent simplification of the management system, and consequently a considerable reduction in costs of production and use, with a good reduction in energy consumption as well.

A second advantage and purpose consists in the reduction of the overall dimensions of the structures and mechanisms and in the simplification of maintenance works.

A third advantage and purpose consists in increasing the speed of movement of the cabin.

In conclusion, these advantages, they have the merit not negligible, to achieve a system of vertical and horizontal movement of the cabin of transport in a system elevator translator with a good technological content.

These and other advantages will appear in the following detailed description of some preferred embodiments with the aid of the enclosed schematic drawings whose details of execution are not to be considered limitative but only and exclusively illustrative.

DETAILED DESCRIPTION OF SPECIFIC EMBODIMENTS

Figure 1:
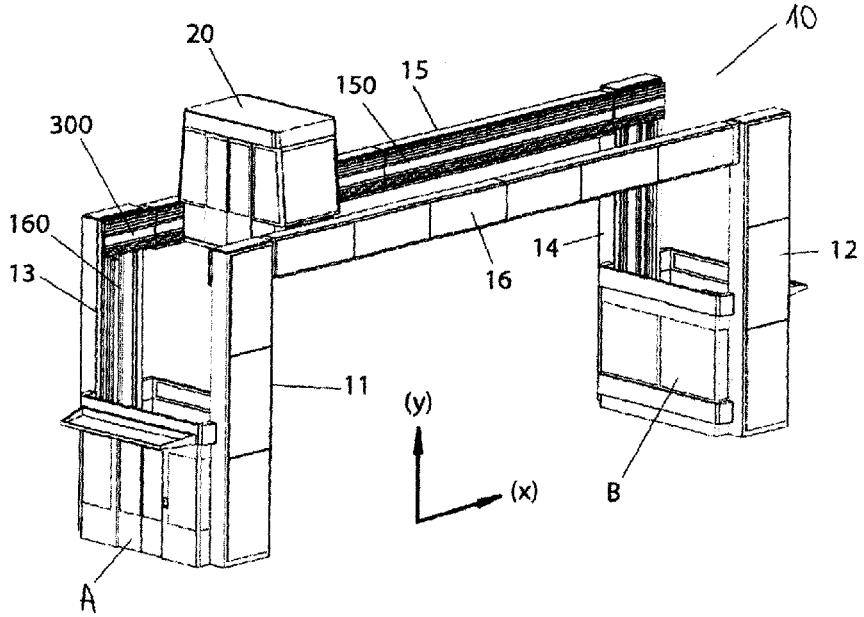
FIG. 1 is an isometric view of the urban elevator translator plant, of the type with a cabin of transport.
Figure 2:
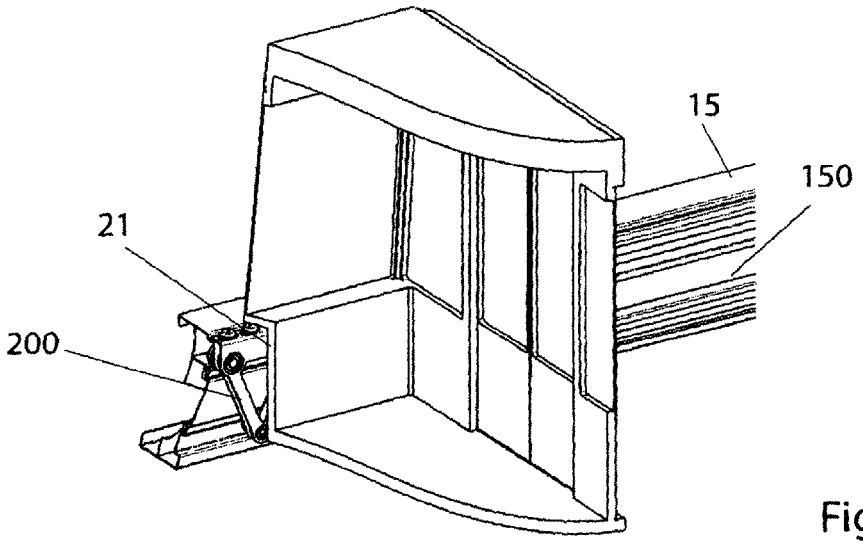
FIG. 2 is a partial view of the cabin of transport bound to the guide beam of the overpass portal of the urban elevator translator plant of which in FIG. 1.
Figure 3:
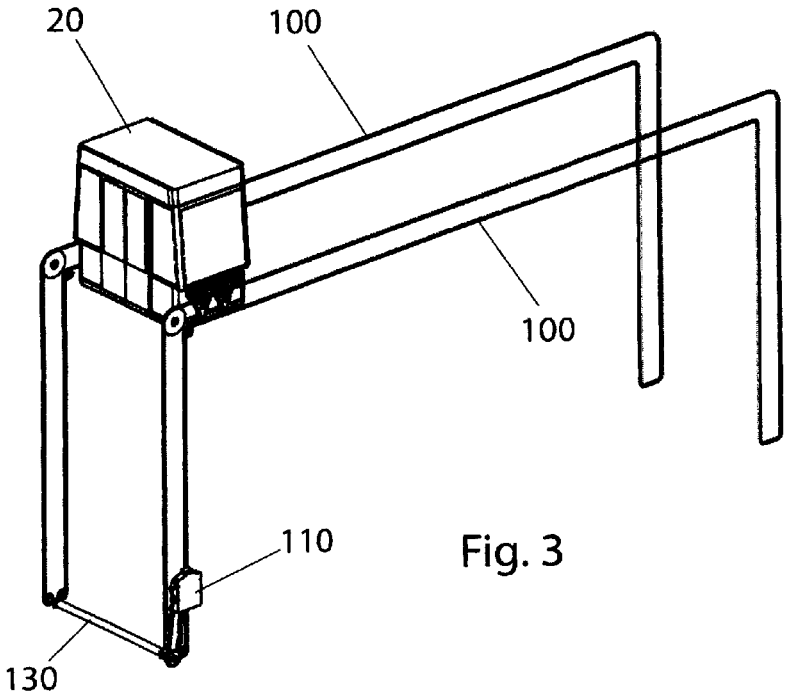
FIG. 3 is a view of the only closed circuit of the chain of movement of the cabin of transport.

FIG. 1 represents the urban elevator translator plant for the crossing of obstacles, which integrates the movement system object of the present invention, which is composed essentially of a "U" portal (10) upside down so arranged as to bypass the obstacle, and with a cabin of transport (20) that moves, by means of a movement system later described, in and from along said upside-down "U" portal (10) from a departure station (A) to an arrival station (B) and vice-versa, where the said station of departure (A) is formed at a first end of the portal (10) and the station (B) is formed at the second end of the portal (10). The cabin of transport (20) is therefore movable from a station of departure (A) to a station of arrival (B) and vice-versa through the means of said system of movement both vertically and horizontally.

The portal (10) (FIG. 1) consists of vertical guide columns (11, 12, 13, 14) and by horizontal guide beams (15, 16), respectively, a pair of vertical guide columns (11, 13) among them departed and positioned parallel to a side of the obstacle to overcome in correspondence to the first station of departure/arrival (A, B) of the cab (20), a pair of vertical guide columns (12, 14), also parallel and departed, positioned on the opposite side of the obstacle to overcome, in correspondence to the second station of departure/arrival (A, B). Two corresponding horizontal guide beams (15, 16), parallel and departed, join each pair of vertical guide columns (11, 13) and (12, 14) so as to achieve two parallel arches and departed with a portal configuration (10) by upside-down "U", said first and second arches resulting symmetrical, the one facing and departed from the other so as to include the path between the same in and from the cabin (20). Between the first two pairs of vertical guide columns (11, 13) is made the departure station or vice-versa of arrival (A), of the cabin of transport (20), while between the pair of vertical guide columns (12, 14) is made the station of arrival or vice-versa of departure (B).

In this way, the cabin (20) can move according to precise input, in and from, along the portal (10), engaged in correspondence of the flanks (21), to said columns of vertical guide (11, 12, 13, 14) and horizontal guide beams (15, 16) following a path whose component of motion develops substantially along the horizontal and vertical axes (x, y) (FIG. 1A).

Figure 4:
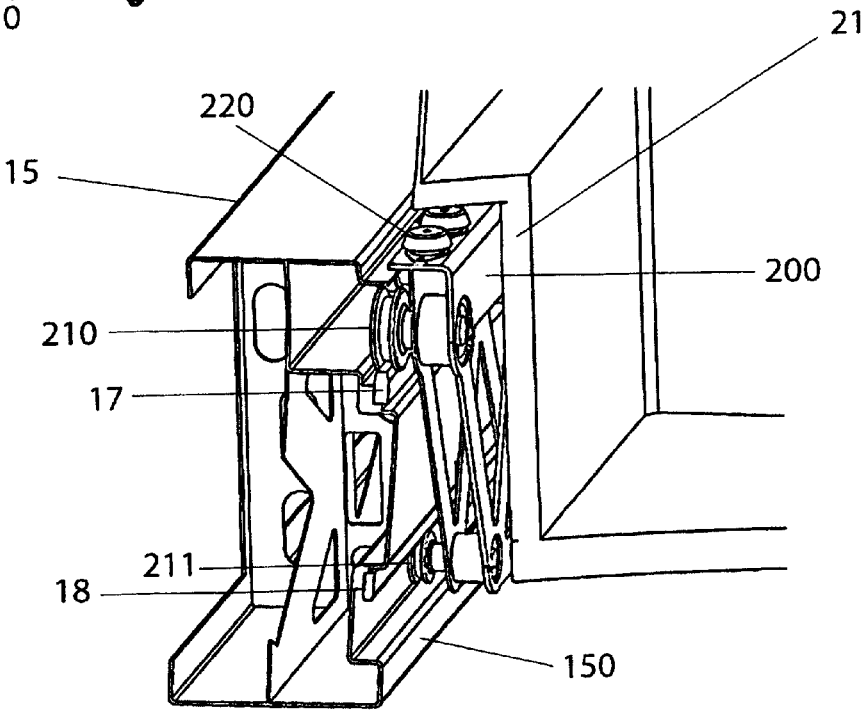
FIG. 4 is a sectional view on the transversal and partial plane of the cabin constrained to the slide that is slidable with respect to the horizontal beam of the portal of overpass.
Figure 5:
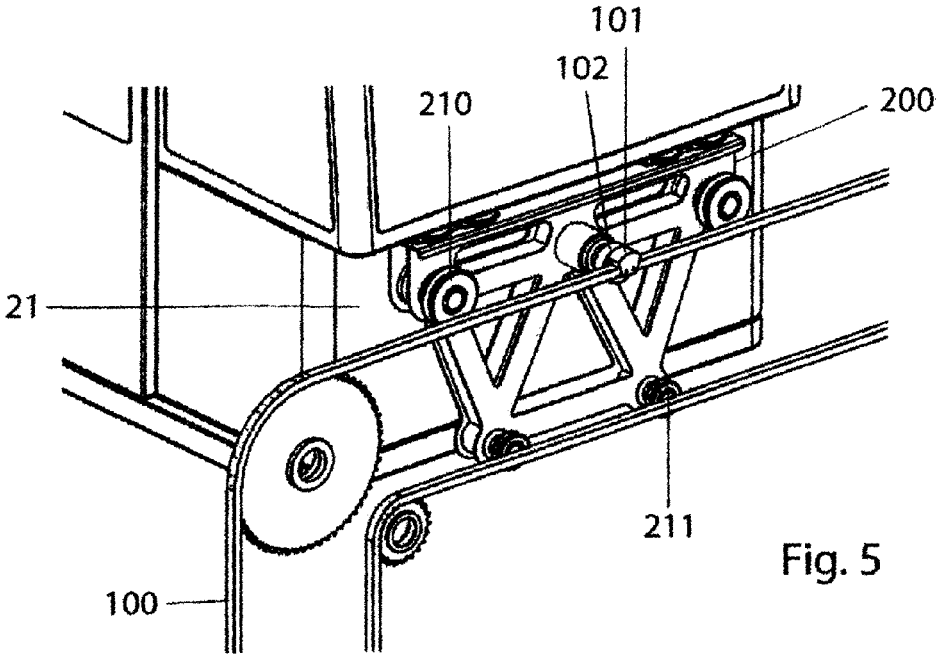
FIG. 5 is a view of the slide, engaged to the movement chain of the cabin of transport, which is slidable with respect to the beam in the horizontal portal of overpass.

The movement system object of the present invention, provides that, in order to allow movement and support of the cabin (20) along the horizontal and vertical axis (x, y), the connection between the flanks (21) of the cab (20) to the vertical guide columns (11, 12, 13, 14) and the horizontal guide beams (15, 16), is obtained by means of at least one slide (200) (FIG. 5). The slide (200) (FIG. 5), has a geometric figure essentially trapezoidal and is provided with a row of upper wheels (210) parallel with respect to a row of lower wheels (211) so as to slide (FIG. 4), in the case of the translation of the cabin (20) along the horizontal axis (x) with respect to the parallel guide rails (17, 18) which are parallel, longitudinally and made in correspondence of the horizontal inner faces (150, 160) (FIG. 1) of said horizontal guide beams (15, 16). Each slide (200) is fixed to the corresponding flank (21) of the cabin (20) by means of anti-vibration dowels (220) that allow to effectively isolate the said cabin (20) by the vibrations and to compensate for any deformation or geometrical alterations. Some specific advantages of this constructive assembly (FIGS. 1-5), composed of horizontal guide beams (15, 16), parallel guide rails (17, 18) and slides (200) are:

- Containment of the bulkiness and the vertical stroke (y axis), as the cabin (20) does not rest on beams (15, 16) protruding completely above them, but rather moves between them. In this way the height engaged over the net clearance above the obstacle appears to be corresponding to the height of the cabin (20). The containment of space leads to a consequent reduction in environmental impact.
- Easy protection of the guide rails (17, 18) of said horizontal guide beams (15, 16), given by their position on the corresponding faces (150, 160) vertical and possibility of their masking through brushes or flexible sheaths, not illustrated.
- Lightweight, good load capacity and good stability. The bearing section of the beams (15, 16) that make up the horizontal side of the arches is comparable to that of the beams of an overhead crane, light weight but with great load carrying ability. The support points of the beams are in correspondence with the outer corners of the rectangle that contains the plant of the machine. There aren't then loads that extend beyond the outline. The basements result thus minimal in relation to the size and weight of the structure.

The beams of the horizontal guide (15, 16), in said portal (10), are joined with the ends to said vertical guide columns (11, 12, 13, 14) (FIG. 1, 6) so as to allow to the cabin (20) also the achieving of the vertical movement with the help of carriages (300), with respect to each pair of columns (11, 13) and (12, 14) of said portal (10) along the vertical axis (y). More specifically, (FIG. 6), in correspondence of the inner faces (160) of said columns of vertical guide (11, 12, 13, 14) are obtained some guides (190, 191) so as to allow the vertical sliding of said carriages (300) which raise the cabin (20). On the inner side of said carriages (300) which are constituted by a shaped plate sliding along said inner faces (160) of said vertical guide columns (11, 12, 13, 14), there are the rails of extension (170, 180) of the rails (17, 18) of said guide beams (15, 16). Prolongation of said rails (170, 180) allow the slides (200) that laterally support the cabin (20) to take and to engage said carriages (300) so as to move the cabin (20) in the vertical direction and along at least one of said pairs of columns of guide columns (11, 13,) or (12, 14), of the vertical guide columns (11, 12, 13, 14). The advantages of this second element are:

- Footprint containment of the stations of arrival and departure (A, B) measured orthogonally with respect to the obstacle (along y) as the columns (11, 12, 13, 14) overlap and do not project beyond the outline of the stations (A, B), as they are seen by an observer that positions itself to look along an axis parallel to the obstacle. The footprint containment leads to a consequent reduction in environmental impact.
- Lightness, good load capacity and good stability of the cabin (20). The section of the guide columns (11, 13,) and (12, 14) that make up the vertical sides of the portal (10) is contained as the same does not have to withstand offset loads. The support points of the vertical guide columns (11, 12, 13, 14) are in correspondence with the outer corners of the rectangle that contains the plant of the portal (10). The bases are thus minimal in relation to the size and weight of the structure.
- Possibility of acting on the carriages (300) with a system of load balancing in order to reduce the power required for the displacement of the cabin (20) in the vertical sections.
- Possibility to equip said carriages (300) of autonomous anti-fall devices in order to ensure the locking in case of anomaly and thus, hinder the unwanted fall or climb of the cabin (20).

The system of vertical and horizontal movement of the cabin of transport (20) comprises a suspension device of the carriages (300) (FIGS. 7A, 7B, 7C) which engages, through the slides (200), said cabin (20). The suspension device of the carriages (300) provides for the use of ropes or chains (400) which are bound to their opposite ends (401, 402) to the two opposing carriages (300) of the same arch. Said ropes or chains (400), through a series of delays—such as for example pulleys, sprockets or crowns (405, 410)—raise a slide attachment (403) on which they insist in traction the hydraulic cylinders (500) for the balancing. Said device, allows to apply alternately, to both opposite carriages (300) of each of the two arches the thrust of a single balancing system. In the specific application of the pedestrian overpass by portal (10), where during a cycle of displacement of the cabin (20) from side to side of the obstacle, the weight lifted on a vertical side is the same that is lowered on the opposite vertical side, this unique balancing system for two opposite carriages (300), makes sure that the thrust supplied to the cabin (20) by the balancing system on one side of the obstacle during the ascent of the same cabin (20), is compensated by a thrust equal but of opposite direction on the opposite side from the cabin on the same balancing system during the descent of the same cabin (20). From this is obtained that the energy provided on one side of the obstacle by the balancing system during the ascent, subject of course to the efficiency of the mechanical system that is affected by friction, from the accelerations and decelerations, be the same that is returned to the same balancing system during descent on the opposite side of the obstacle. For example, if for lifting the cabin (20) on the right side of the portal (10) is provided a thrust upwards of 100 kg, the same cabin (20) whose weight does not vary after the horizontal translation (x axis) along the beams (15, 16) returns a downward thrust of 100 kg on the opposite side. In this way, the amount of energy given and received by the system of balancing springs which is the same for both opposite vertical sides, will be automatically balanced during a cycle of movement of the cabin (20) from one side to the other of the obstacle.

The advantages of said suspension device of the carriages (300) are:

- Reduction of the balancing systems number as the same system is used for two opposing carriages (300) of the same arch in the portal (10).
- Reduction of the energy consumption of the plant because a large part of the energy supplied during the ascent of the cabin (20), is recovered during the descent of the same.
- Containment of the overall dimensions and the complexity of the portal (10).

Figure 7A:
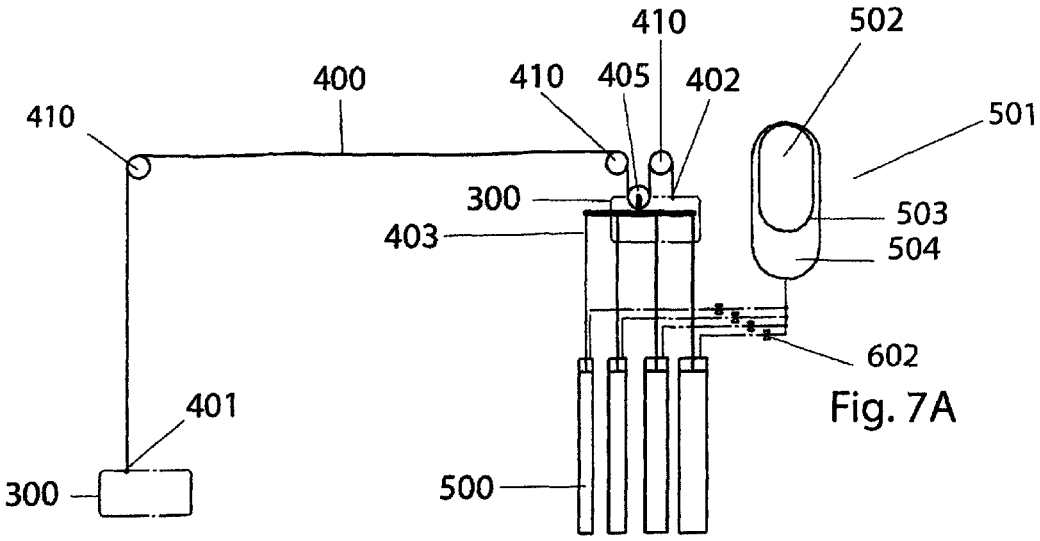
FIGS. 7A, 7B and 7C is the assembly diagram of the device for the suspension and balancing of the carriages, in some working conditions, in order to enable the cabin (20) the achievement of the vertical movement.
Figure 7B:
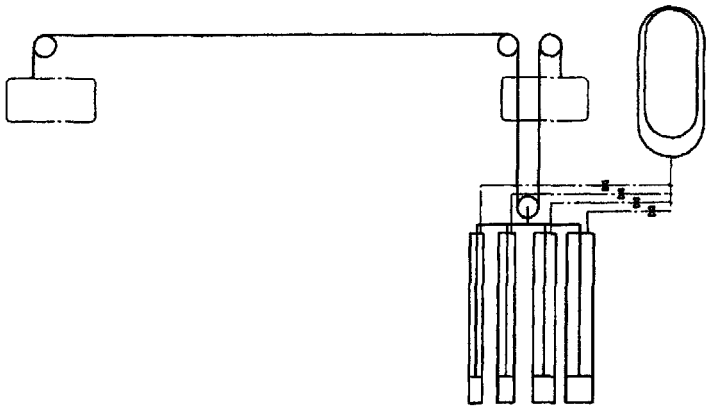
Figure 7C:
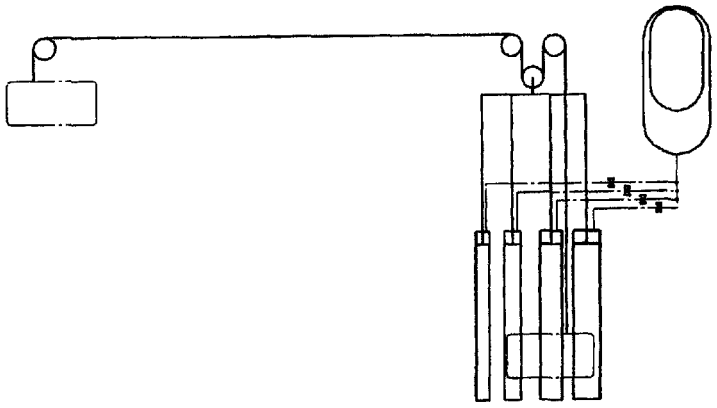
Figure 9:
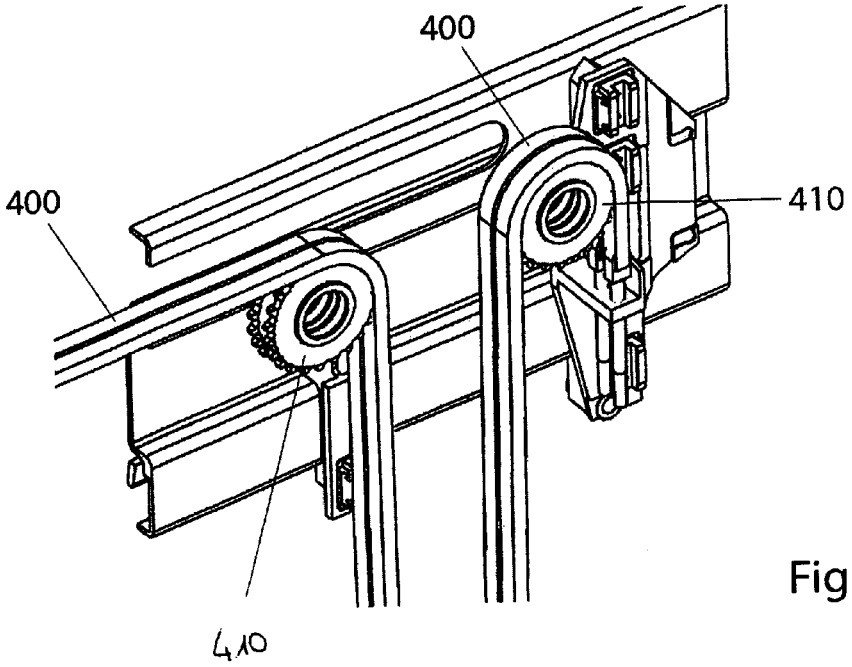
FIG. 9 is a detailed view of the transmission means of the chains or cables of the suspension device of the carriages of FIGS. 7A, 7B and 7C.

The said movement system comprises the device for balancing the weight of the cabin (20) in the case of vertical path, which is of the adaptive type. In substance, said balancing device of the carriages (300) (FIG. 7A) takes advantage of the hydraulic cylinders (500) fed by hydropneumatic accumulators (501) in which some pressurized gas (502) in the inside of an elastic bag (503), allows to maintain pressure in an oil reservoir (504). This hydraulic system shall comply with the same way as a set of springs which act (FIG. 9) by means of some chains or ropes (400) and by some idler wheels (410) balancing the weight of the cabin (20), composed of the real weight of the cabin, the elements rigidly coupled thereto, as well as by the load transported. The said balancing device, is characterized by the fact of being able to vary the balancing power based on the actual load. To establish this balancing device are adaptive sets of several hydraulic cylinders (500) characterized by different bore and stems between them. Said cylinders (500) are chosen so that the series of combinations of values of thrust (or traction) obtainable by a whole formed by one or more of them, ultimately allows to apply, through the system of returns (405, 410), a thrust as much as equal and opposite to that exerted by the weight of the cabin (20) and of its load; and this approximating all the loads inside the range of allowable load for the machine. A weighing system, through some load cells detects the weight that insists on the cabin (20). The electronic system which supervises the management of the balance, based on the load detected by said load cells, takes care of opening the valves (602) of those cylinders (500) which can realize a thrust as close to that required to maintain balance in the cabin (20) with its cargo. (FIGS. 7A, 7B, 7C).

By way of example, it's considered to have loaded into the cabin (20) a weight of 340 kg. Through the load cells the management system of the adaptive balance is in charge of opening the valves (602) of the cylinder (500) number one and three and to maintain closed the valves (602) of the cylinders number two and four so as to exert a thrust compensation of 220 kg (in addition to the weight of the cab (20)). In this way the residual weight that the movement system of the cabin (20) must elevate will be given by: 340−220=120 kg. The advantages of this adaptive balancing system are:

- Lower energy consumption for cargo movement. So much lesser, so much contiguous will be the steps of the scale of the thrusts obtainable by the combinations of the cylinders (500) used.
- Space saving and better chance of dislocation of the system of compensation with respect for example to systems with cast iron or other heavy material counterweights.

In order to obtain a similar system of adaptive balancing it can still be used in place of the hydraulic cylinders (500) with hydropneumatic accumulators, a series of blocks of cast iron or other heavy material stacked one above the other and a coupling system that allows, always through the data detected by a weighing system, to hook it or unhook it automatically to a suspension system as described above, depending on the actual load applied.

Another possibility to obtain a similar system of adaptive balance is to use, as an alternative to the set of hydraulic cylinders, a variable displacement hydraulic pump that is also a variable displacement hydraulic motor according to the needs, this pump/motor meshing on a rack and moving a slide (403) of a suspension system of the type described above. In this case the control system, according to the weight of the cabin (20) will vary accordingly to the displacement of the pump/motor so that the same provides adequate thrust balancing. During the descent of the cabin on the opposite side, reversing its function from motor to pump and keeping unchanged the displacement, the same pump/motor will return to the hydraulic system the energy previously consumed.

Figure 10:
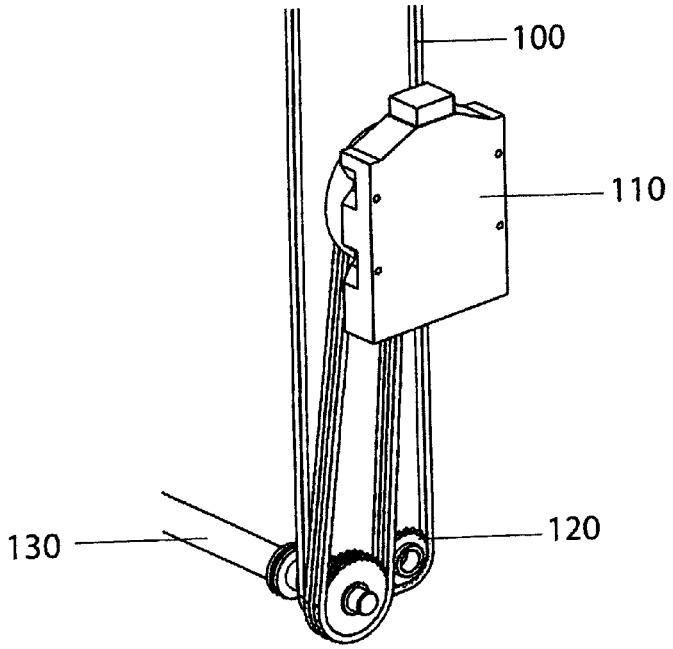
FIG. 10 is a detailed view with the device which drives the chain of movement of the cabin according to the vertical and horizontal directions.

Always the said movement system of the cabin (20) comprises a ring chain (100) (FIG. 5) that allows to move the cabin (20) along the vertical and horizontal directions (x, y) through a single motor (110). Said chain (100) is arranged in closed ring through a series of pinions and crowns (120) (FIG. 10) so as to follow the trajectory of the cabin (20) and remained attached through a pin (101) (FIG. 5) that is integral with the slide (200) (FIG. 5). The chain (100) is fixed to the pin (101) which also acts as master-rope for the two ends of the chain (100) which close the ring. This pin (101) can rotate on itself so as to follow the variations of direction. By acting directly or indirectly on the chain (100), by means of the motor (110), it is possible to realize the movement in both directions, forward and backward. Thus determining the displacement of the cabin (20) in all directions vertical and horizontal by means of the same motor (110). In the specific case of the system of vertical and horizontal movement for the pedestrian crossing composed of two arches that support a single cabin (20) that slides inside, by means of the shaft of synchronism (130) (FIG. 10) it is possible to simultaneously control two systems of chain (100) ring on the two opposite arches. The advantages of this feature are:

Possibility of using a single motor (110) and a single system of command and control to achieve all the vertical and horizontal movements of the cabin (20).

Figure 6:
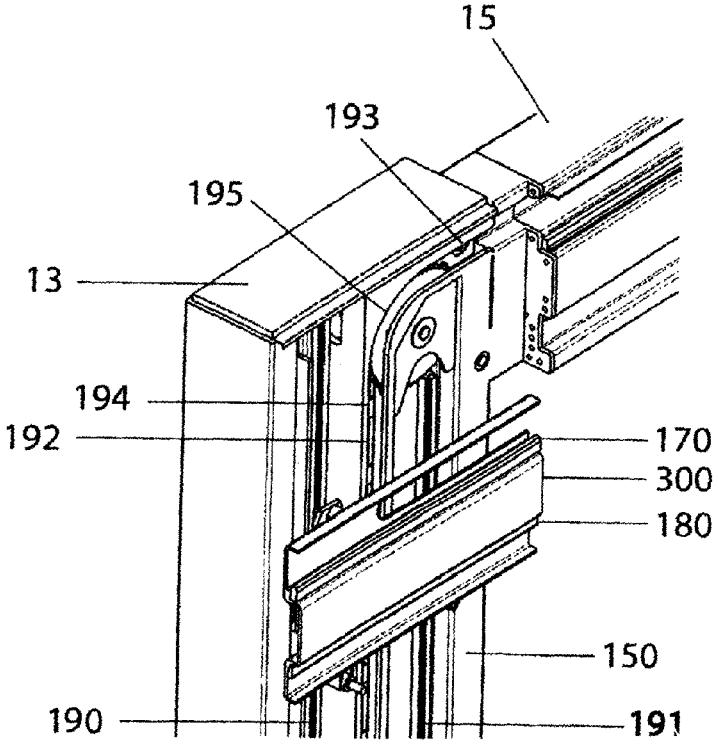
FIG. 6 is a view of the vertical guide column and the relative carriage in correspondence with the union to the guide beam of the horizontal portal of overpass.
Figure 11:
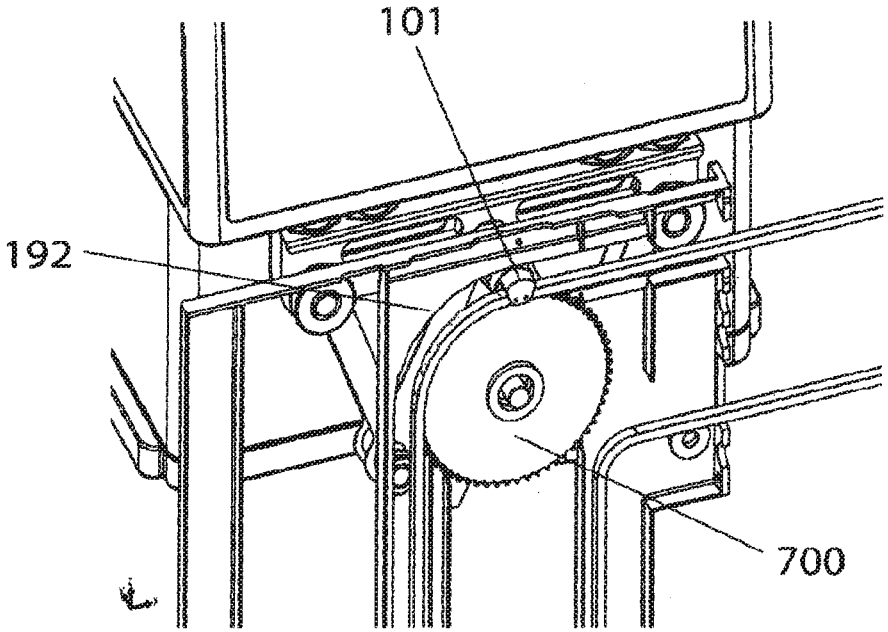
FIG. 11, is a view of a detail of the movement system in correspondence of the coupling union of the guide column to the corresponding guide beam.

A further feature of the movement system, object of the present invention, is constituted by the hollow guide (192) formed at the inner faces (160) of said columns of vertical guide (11, 12, 13, 14) of the corresponding arch within which slips and is guided a wheel (102) the axis of which coincides with that of the rotating pin (101) which is fixed to the ring chain (100) that moves the cabin (20) (FIG. 6). The said hollow guide (192) has a horizontal portion (193) (FIG. 6) within which the pin slips allowing to keep in position of maximum elevation the carriage (300), winning thus the eventual action of the weight of the cabin (20) when this would tend to lower the same carriage (300) and while the wheels (210) of the slide (200) integral with the cabin (20) there rise completing its horizontal stroke. The same guide is provided then of a vertical section (194) that follows the entire length of the vertical stroke of the cabin (20). This vertical portion (194) of the hollow guide (192), via the wheel (102) of the pin (101) which slides inside, allows to keep in position the cabin (20) without that the said cabin (20) can move horizontally while crosses the vertical stroke (194). The same hollow guide (192), with its curved section (195) tangent to the horizontal (193) and vertical sections (194), determines the change of direction of the movement of the cabin (20) from vertical to horizontal and vice-versa, following a trajectory a quarter of a circle. In correspondence of said hollow guide (192) in its curved section (195) is provided the sprocket (700) whose primitive diameter and whose axis of rotation correspond to the primitive diameter and the axis of the circle of the hollow guide (192) in its curved section (195) (FIG. 11). Said sprocket (700), together with the rotating pin (101, 102) make sure that the chain (100) follows exactly the path of the cabin (20), which is determined by the sliding of the wheel (102) of the rotating pin (101, 102) within the hollow guide (192). The advantages of this additional characteristic are:

Comfort for the passengers transported in the cabin (20) since the change of direction from horizontal to vertical and vice-versa occurs gradually.

Reduced travel time because it's possible to move the cabin (20) along a shortest path without ever stopping it for then restarting it in a different direction.

Reduced energy consumption.

Figure 8A:
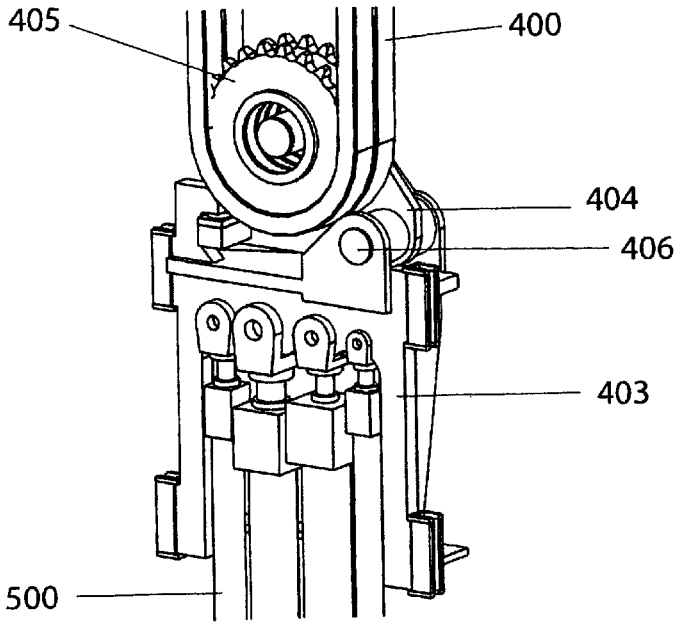
FIGS. 8A, 8B are detailed views of a part of the suspension device of the carriages.
Figure 8B:
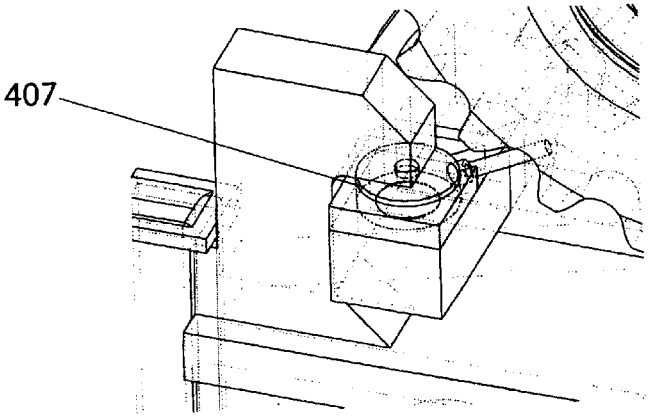

Yet one characteristic of said movement system, consists of a rocker arm (404) (FIG. 8A) that supports the pulleys or the toothed pinions (405) for the ropes or for the chains (400) of suspension respectively, which constitute the suspension system of the cabin (20) and its load. Said rocker arm (404) is made integral to the slide (403) moved by the cylinders (500) through a pin (406) around which the same rocker arm can rotate. On the opposite side of the pin (406) is placed a load cell (407) (FIG. 8B) between the rocker arm itself and the slide (403) in such a way that the traction exerted on the pulleys or on the toothed pinions (405) is transferred through the load cell (407) to the slide (403). In this way the load cell (407) is stressed proportionally to the load of the cabin (20). Thus through a single load cell (407) it is possible to detect the weight on both carriages (300) opposite of one arch. The advantages are:

Reduce the number of load cells required.

Space saving for the movement plant.

Other advantages in favor of the system of movement resulting from the collection of the elements that compose it, or by a combination of some of them, consist in the fact that it's obtained:

The increase in the safety of the urban elevator translator system derived from the splitting of the balancing function in the features of vertical run by the movement function of the cabin. In case of problems to the apparatuses that involve one of two functions, the apparatuses involving the other function cooperate to maintain the position of the cabin (20).

The spaces occupied by the movement plant are contained as most or all of the components are contained inside the structure itself, in particular within the columns of vertical guide (11, 12, 13, 14) and the horizontal guide beams (15, 16), which form the arches.

LEGEND (10) portal by upside-down "U"
(20) transport cabin
(21) flanks
(A) station of departure/arrival
(B) station of departure/arrival
(11, 12, 13, 14) columns of vertical guide
(15, 16) horizontal guide beams
(17, 18) guide rails
(x, y) vertical and horizontal axis
(100) ring chain
(101) rotating pin
(102) wheel
(110) motor
(120) pinions and crowns
(130) shaft of synchronism
(150, 160) vertical and horizontal inner faces
(170, 180) extension rails
(190, 191) guides
(192) hollow guides
(193) horizontal portion of the hollow guide
(194) vertical portion of the hollow guide
(195) curved portion of the hollow guide
(200) slide
(210) upper wheels
(211) lower wheels
(220) anti-vibration dowels
(300) carriages
(400) ropes or chains
(401, 402) opposite ends
(403) cylinders slide attachment
(404) rocker arm
(405) toothed pinions
(406) rocker arm pin
(407) load cell
(410) return wheels
(500) hydraulic cylinders for balancing
(501) hydropneumatic accumulators
(502) gas in pressure
(503) elastic bag
(504) oil tank
(602) valves
(700) sprocket

The invention claimed is:

1. A system of movement of a transport cabin (20) for transporting people and things, along an overpass constituted of a portal (10) of an urban elevator translator plant, across an obstacle and joins in and from a first station of departure/arrival (A) and a second station of departure/arrival (B), comprising:

a portal (10), the portal (10) comprising a first pair of vertical guide columns (11, 13), a second pair of vertical guide columns (12, 14), and a pair of horizontal guide beams (15, 16), wherein the first station of departure/arrival (A) of the transport cabin (20) is arranged between the first pair of vertical guide columns (11, 13) and positioned on a first side of the obstacle, the second station of departure/arrival (B) of the transport cabin (20) is arranged between the second pair of vertical guide columns (12, 14) and positioned on a second side of the obstacle opposite the first side of the obstacle, wherein the pair of horizontal guide beams (15, 16) join each of the first and second pairs of the vertical guide columns (11,13 and 12,14) so as to achieve a pair of parallel and symmetrical arches;

a slide (200), wherein a row of upper wheels (210) parallel with respect to a row of lower wheels (211) constrain the slide (200) to the transport cabin (20) so as to slide the transport cabin (20) along a horizontal axis (x) with respect to a pair of guide rails (17, 18), wherein each of the guide rails (17, 18) corresponds to an inner face (150) of the horizontal guide beams (15, 16), wherein the slide (200) connects a pair of flanks (21), the transport cabin (20), the vertical guide columns (11, 13, 12, 14) and the horizontal guide beams (15, 16), wherein the transport cabin (20) is adapted to transition from horizontal movement to vertical movement by means of a hollow guide (192) in the vertical guide columns (11, 13, 12, 14);

a carriage (300) engageable with the slide (200) so as to slide the transport cabin (20) along a vertical axis (y) with respect to a pair of guides (190, 191), wherein the guides (190, 191) correspond to an inner face (160) of a respective one of the vertical guide columns (11, 13, 12, 14);

a ring chain (100) bound to the slide (200) and moveable by a motor (110), so as to allow movement and support of the transport cabin (20) along the horizontal and vertical axis (x, y), wherein the ring chain (100) is arranged in closed ring through a series of pinions and crowns (120) so as to follow a trajectory of the transport cabin (20) and remain fixed to a pin (101), wherein the pin (101) acts as a rope-head for the two ends of the ring chain (100), wherein the pin (101) can rotate on itself so as to follow variations in direction;

a suspension device of the carriages (300), wherein the suspension device of the carriages (300) engages the transport cabin (20) by means of the slide (200), the suspension device of the carriages (300) having a rope or a chain (400), the rope or the chain (400) bound to an opposite end (401, 402) to the carriages (300) opposite of each other of the same arch, and that through a series of returns (405, 410) raises a slide attachment (403) associated with an adaptive set of several hydraulic cylinders (500) for balancing, so as to apply alternately, to both opposite carriages (300) of each of the two arches the traction of a single adaptive balancing system, wherein the adaptive balancing system is characterized by an ability to vary a balancing power based on a load of the transport cabin (20);

wherein the adaptive set of several hydraulic cylinders (500), characterized by different bore and stems between them, are fed by at least one hydropneumatic accumulator (501), wherein the hydropneumatic accumulator (501) comprises a pressurized gas (502) inside an elastic bag (503) and allows to maintain pressure in an oil reservoir (504);

wherein the suspension device of the carriages interacts with a weighing system and an electronic system, wherein the weighing system detects a weight of the transport cabin (20) through at least one load cell, the electronic system supervises a balance management based on the load detected by the load cells and opens at least one valve (602) of the cylinders (500), wherein the cylinders (500) can realize a thrust as close to that necessary to maintain in equilibrium the transport cabin (20) and the load of the transport cabin.

2. The movement system according to claim 1, further comprising a rocker arm (404) that supports pulleys or toothed pinions (405) for the ropes or chains (400) for suspension respectively;

wherein the rocker arm (404) associated with the slide attachment (403) moves by means of the cylinders (500) and having at least one load cell (407) between the rocker arm and the slide attachment (403) in such a way that the traction exerted on the pulleys and toothed pinions (405) is transferred by means of the load cell (407) to the slide attachment (403) so that the load cell (407) is stressed in proportion to the load of the transport cabin (20).

3. The movement system according to claim 2, wherein the hollow guide (192) comprises a horizontal section (193), a curved section (195), and a vertical section (194), the curved section tangent to the horizontal section (193) and vertical section (194) determines a variation of direction of movement of the transport cabin (20) from vertical to horizontal and vice-versa, following a trajectory of a quarter of a circle.

4. The movement system according to claim 3, wherein the hollow guide (192) further comprises a wheel (102), the wheel (102) having an axis that coincides with the pivot pin (101) and its respective axis, the pin (101) being fixed to the ring chain (100) that moves the transport cabin (20).

5. The movement system according to claim 4, wherein the pin (101) slips into the horizontal section (193) allowing the carriage (300) to stay in a position of maximum elevation, thus overcoming a possible action of the weight of the cabin (20) while the slide (200) mounts on the carriage (300).

6. The movement system according to claim 5, wherein the ring chain (100) and the pivot pin (101) flow around a sprocket (700), the sprocket having a primitive diameter and a center of rotation that coincides with a primitive diameter and a center of the curved section (195) of the hollow guide (192).

* * * * *